US005418832A

United States Patent [19]

Barnes

[11] Patent Number: 5,418,832

[45] Date of Patent: May 23, 1995

[54] SCANNING RADIOGRAPHIC DEVICE WITH SLIT, SLOT AND GRID

[76] Inventor: Gary T. Barnes, 2250 Shady Creek Trail, Birmingham, Ala. 35216

[21] Appl. No.: 147,361

[22] Filed: Nov. 5, 1993

[51] Int. Cl.[6] ..... G21K 3/00

[52] U.S. Cl. ..... 378/146; 378/7; 378/154

[58] Field of Search ..... 378/146, 149, 154, 156, 378/157, 147, 116, 7, 160; 250/363.1

[56] References Cited

U.S. PATENT DOCUMENTS

| | | | |
|---|---|---|---|
| 4,096,391 | 6/1978 | Barnes | 250/505 |
| 4,277,684 | 7/1981 | Carson | 378/7 |
| 4,731,807 | 3/1988 | Plessis et al. | 378/156 |
| 4,792,900 | 12/1988 | Sones et al. | 364/413 |
| 5,164,976 | 11/1992 | Scheid et al. | 378/146 |

OTHER PUBLICATIONS

Reduction of Scatter in Diagnostic Radiology by Means of a Scanning Multiple Slit Assembly, Radiology, vol. 120, No. 3, pp. 691–694, Sep. 1976, Radiological Society of North American, Incorporated.

Scanning Multiple Slit Assembly: A practical and Efficient Device to Reduce Scatter, Gary T. Barnes et al., Am J Roentgenol 129:497–501, Sep. 1977.

The design and performance of a scanning multiple slit assembly, Gary T. Barnes et al., Med. Phys. 6(3), May/-Jun. 1979.

Experimental measurements of the scatter reduction obtained in mammography with a scanning multiple slit assembly, Michael V. Yester et al., Med. Phys. 8(2), Mar./Apr. 1981.

*Primary Examiner*—David P. Porta
*Assistant Examiner*—Don Wong

[57] ABSTRACT

A scanning radiographic system having reduced scatter and improved tube loading employs a pre-patient slit to form the x-ray beam into a fan beam and a post-patient slot to eliminate scattered rays from the fan beam. A grid incorporated into the slot permits a further reduction of scatter sufficient to employ a wider slot without detrimental increase in scatter but with significant improvement in tube loading. The lamellae of the grid proceed diagonally across the width of the slot to reduce grid lines and are tipped to focus on the focal spot of the x-ray source.

6 Claims, 3 Drawing Sheets

SCANNING RADIOGRAPHIC DEVICE WITH SLIT, SLOT AND GRID

FIELD OF THE INVENTION

The present invention relates to scanning radiographic equipment and in particular to a method of improving the contrast of images obtained with fan beam scanning systems.

BACKGROUND OF THE INVENTION

Conventional x-ray radiography records the attenuation of x-ray radiation, over the surface of an image plane, after it has passed through a patient. The attenuation is typically recorded as a pattern or "image" on a sheet of x-ray film.

The pattern of attenuation ideally indicates the relative opacity (to x-rays) of the patient along many rectilinear "rays" extending from the x-ray source through the patient to the film. Ideally, each point of the film image indicates the total attenuation caused by internal structures of the patient along a single ray.

In practice, however, when x-ray radiation passes through a patient, a certain amount of the radiation is scattered away from its path of incidence. Some of this scattered radiation is still received by the film, although at a point other than where it was originally directed. The scattered radiation causes portions of the x-ray image to receive additional x-ray energy that may not have been attenuated by structure of the patient directly interposed between that portion of the image and the x-ray source. The amount of scatter depends on the material through which the x-rays pass. For example, less scatter is encountered in imaging the lungs, which are of low density, as compared to the mediastinum which is a relatively higher density.

The net effect of scatter is that the contrast of the image, the difference between light and dark portions of the image, is degraded. The contrast of an image, all other things being equal, effects the amount of information conveyed by the image. A decrease in contrast may result in the loss of diagnostically important information.

Scatter has heightened significance in certain applications, such as dual energy bone densitometry, where the attenuation at each portion of image at two energies is determined quantitatively and mathematically combined to isolate different tissue within the patient. Here small amounts of scatter that might be tolerable on a qualitative basis can cause unacceptable quantitative errors.

It has long been known that scatter in conventional radiography may be controlled by the use of a grid consisting of a series of regularly spaced thin plates or lamellae arranged edgewise to allow passage of x-rays only along a straight line path from the x-ray source to the image receptor. Scattered x-rays that do not travel along a straight line path see a much greater area of lead and are preferentially absorbed.

The effectiveness of a grid in passing desirable or "primary" x-rays is measured by its "primary transmission" and depends generally on the ratio of the lamellae's thickness to the space between the lamellae, i.e., the "intergrid spacing" and the "lead content" (mg/cm$^2$) of the grid. Thinner lamellae and greater spacing between the lamellae block fewer primary x-rays. A typical grid may have a primary transmission of approximately 70% and thus there is a significant reduction in total exposure of the film caused simply by the use of the grid. A decrease in exposure of the film, like a decrease in contrast, can reduce the amount of information contained in the image and cause the loss of diagnostically significant details in the image. Accordingly, the use of a grid is not without cost in terms of diagnostic information and the use of a grid is typically considered only when its effect on the reduction of scatter is expected to be significant.

The effectiveness of the grid in blocking oblique or scattered x-rays depends generally on the height of the lamellae, as measured along the rays, in proportion to the spacing between the lamellae. Higher lamellae and lamellae that are spaced closer together block more scattered radiation. The height of the lamellae in proportion to their spacing is typically expressed as a "grid ratio". Typical grid ratios are 8:1 and 12:1 meaning that the lamellae are respectively eight or twelve times as high as the spacing between them.

Grids having strip densities (lines/mm) of substantially less than 100 lines per inch can often produce objectionable grid lines on the resulting image, the grid lines being the shadows of the lamellae. Moving the grid during the x-ray exposure of the image receptor blurs the grid lines over a larger area thus rendering them fainter and thus less objectionable.

With the advent of scanning radiography, where the area x-ray beam is replaced with a highly collimated pencil or fan beam, the problems of scatter have been remarkably reduced. In such systems, the collimated radiation beam is moved in a scanning pattern over an area of the patient to be imaged. Synchronously, a collimating slot is moved to remain opposed to the radiation beam on the opposite side of the patient. Only a portion of the image is exposed at any given time.

The effect of the highly collimated radiation beam and the slot is to eliminate the effect of scattered radiation from rays normally present on either side of the collimated beam during the exposure of any given portion of the image. With suitably narrow radiation beams, the problem of scatter from adjacent rays is virtually eliminated.

Narrowly collimated radiation beams may create significant tube loading problems. Specifically, in order to provide an acceptably short scanning time the radiation beam must provide no less than a certain minimum fluence. The fluence is generally proportional to both the area of the collimated beam and the power of the x-ray tube. Collimation of the x-ray beam to increasing small areas requires correspondingly greater x-ray tube power and much of that increased power is wasted by the narrow collimation. Thus, in practice, extremely narrow radiation beams may be inefficient or unduly expensive.

SUMMARY OF THE INVENTION

The present invention provides a scanning radiographic system that provides reduced scatter and acceptable tube loading. The invention recognizes that the use of a grid in addition to the slot of a low-scatter scanning radiographic system provides significant further scatter reduction. This further scatter reduction permits the use of a wider slot without unacceptable increases in scatter thus dramatically lowering tube loading.

In particular, the system employs an x-ray source producing a fan beam of rays of x-rays directed toward a patient along a beam axis where the fan beam has a cross-sectional length and width measured in a plane perpendicular to the beam axis. A detector array is positioned to receive the fan beam after the fan beam has passed through the patient and to produce an attenuation signal related to the intensity of the received fan beam. The fan beam and detector are arranged to be scanned over a volume of the patient in a direction perpendicular to the cross-sectional length of the fan beam.

A slot, formed of a radio opaque material, has an aperture conforming to the cross-section of the fan beam and is attached to and aligned with the detector array. A grid comprised of a set of radio opaque lamellae extending across the width of the slot is affixed to the slot.

It is one object of the invention to provide a scatter controlling scanning radiographic system with acceptable tube loading. The recognition that a grid provides significant increase in scatter reduction to the already low scatter of a scanning radiographic system permits the width of the fan beam to be increased and tube loading to be reduced without detrimental loss of image contrast.

The lamellae in the grid may be positioned to extending diagonally across the width of the slot.

It is thus another object of the invention to employ the scanning of the scanning radiographic system to eliminate grid lines. By careful selection of the angle of the lamellae within the grid in proportion to the width of the grid and the interlamellae spacing, grid lines may be effectively eliminated. This is true even though the detector and grid have no relative motion whereas eliminating grid lines in a film based system requires the grid be moved with respect to the film.

The lamellae may also be tipped so as to align themselves with the rays of the x-ray radiation.

Thus it is another object of the invention to provide the foregoing benefits in a grid of high efficiency where a minimum amount of radiation is absorbed by the lamellae.

Other objects, advantages, and features of the present invention will become apparent from the following specification when taken in conjunction with the accompanying drawings.

DETAILED DESCRIPTION OF THE PREFERRED EMBODIMENT

Figure 1:
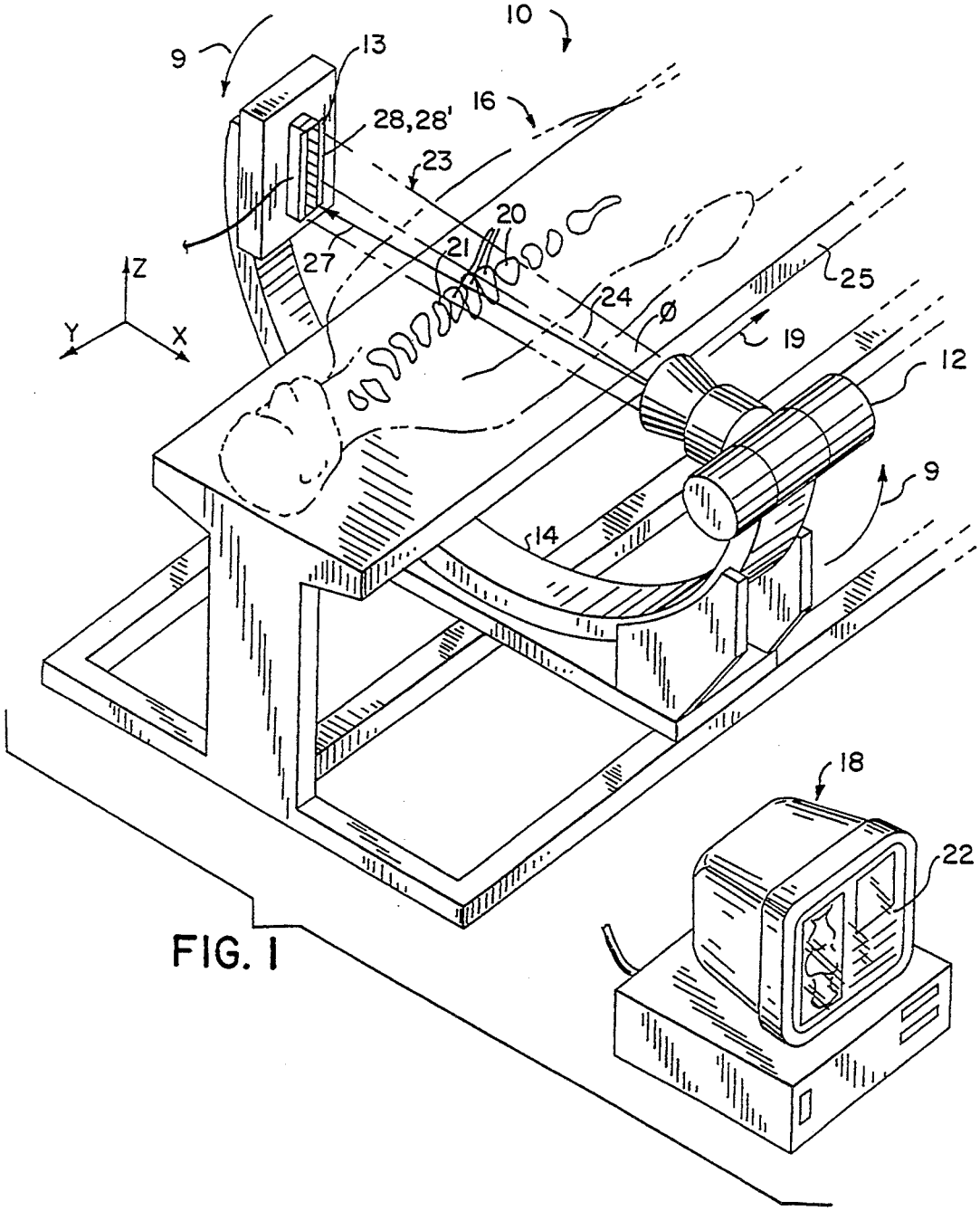
FIG. 1 is a simplified perspective view of a scanning radiographic system showing an x-ray source for producing a fan beam to be received by a detector array.

Referring to FIG. 1, a scanning radiography instrument 10 includes a polychromatic x-ray source 12 and a dual energy detector array 13, both of which are mounted on a common carriage 14 which extends on either side of a supine patient 16. The carriage 14 is automatically operated, as by stepping motors, so as to scan the patient 16 along a scanning axis 19. In studying the human vertebra, the scan is preferably taken from the side of the patient 16, so as to provide a lateral scan of the vertebra 20 of the patient 16. In studying the lungs, (not shown) the scan is preferably taken vertically so as to provide an anterior/posterior scan of the patient 16.

The carriage 14 carrying the radiation source 12 and detector array 13 is connected to, and operates under the control of, a general purpose digital computer 18 which is specifically programmed for use in operating the instrument 10 and analyzing the data and including specialized algorithms for carrying out the calculations required by the present invention. In addition, the present invention includes a data acquisition system ("DAS") and a data storage device, both of which are not shown and may be included in the computer 18. The computer 18 also includes a display means 22 for outputting the data analysis.

Figure 2:
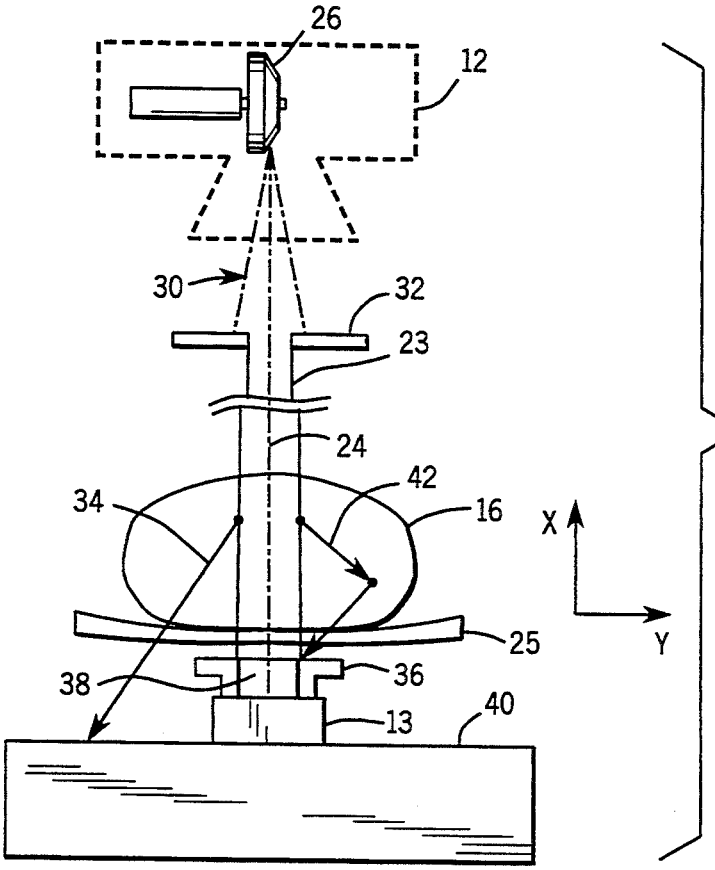
FIG. 2 is a schematic view of the path of the x-ray beams from the x-ray source to the detector array showing placement of a collimating slit, a scatter reducing slot, and a grid per the present invention.

Referring also to FIG. 2, the x-ray source 12 employs a standard x-ray tube having an anode 26 emitting a cone beam 30 of x-rays having a broad range of energies. This cone beam 30 is shaped by means of a rectangular slit 32 into a fan beam 23 as is projected toward the patient 16.

The fan beam 23 has a rectangular cross section as measured in a plane normal to the fan beam axis 24. The longer dimension of the rectangular cross-section of the fan beam 23, i.e., its length, defines the z-axis of a Cartesian coordinate system with the y-axis being aligned with the shorter axis of the rectangular cross section, i.e., its width, and the z-axis being parallel to the fan beam axis 24.

Figure 3:
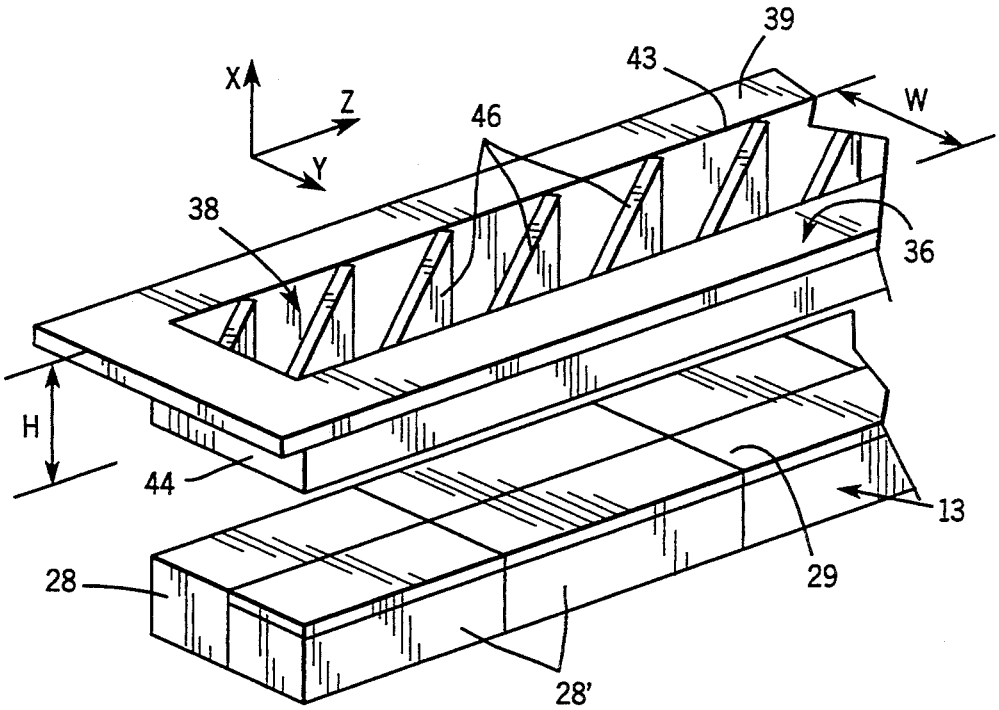
FIG. 3 is a perspective view of the slot and grid of FIG. 2 showing diagonal placement of the lamellae of the grid and the positioning of the grid over the detector array.

Referring to FIGS. 1 and 3, the detector array 13 conforms generally to the cross-section of the fan beam 23 and is comprised of rectilinear rows and columns of detector elements 28 and 28'. The multiple rows of detector elements 28 and 28' span the width of the detector array 13 along the y axis whereas the columns of detector elements 28 span the length of the detector array 13 along the z axis. Each detector element 28, 28' has a z-axis length of approximately 0.5 mm and a y-axis width of approximately 0.5 mm. Although FIG. 3 shows a detector array 13 having only two columns 28 and 28', it should be understood that the invention may be used advantageously with detector arrays having greater than two columns.

The multiple elements 28 or 28' of each row provide data points at different spatial locations for each position of the carriage 14 along the scanning axis 19 (or y-axis), thus permitting the acquisition of a two dimensional array of data points with scanning in only a single direction.

The two rows provide measurements of the attenuated x-ray radiation within two different energy bands. One row of elements 28' incorporates a copper filter 29 on its surface facing the x-ray source 12 to be preferentially sensitive to high energy x-rays. The remaining row of detector elements 28 has no filter and is responsive to low energy x-rays. Each elements 28 or 28' is one cell of a charge coupled device responsive to light emitted by a surface coating of an x-ray scintillator such as is known in the art.

Alternatively, the detector array may be constructed as a "sandwich" of different superimposed detector layers as taught by U.S. Pat. No. 4,626,688 issued Dec. 2, 1986 entitled: Split Energy Level Radiation Detector, and U.S. Pat. No. 5,138,167 issued Aug. 11, 1992 and entitled: Split Energy Radiation Detector, both hereby incorporated by reference.

During the scanning of the patient 16, the analog output of the detector array 13 is sampled and digitized by the DAS so as to produce x-ray intensity values for each of the data elements 28 and 28' of the detector array at each spatial location of the scan, the values which may then be transmitted to the computer 18 which stores the data in a computer memory (not shown) or a mass storage device.

The spatial locations of the stored values differ by the distance that the source 12 and the detector array 13 moves along the scanning axis 19 between the taking of each value. In the preferred embodiment, the instrument moves approximately 0.25 millimeters between the acquisition of each data point.

At the completion of the scanning, the computer 18 arranges the values obtained in the scan in a matrix within its memory where pairs of values are associated with single spatial location, defined by the position of the carriage 14 when the data element was acquired. Specifically, the data from one column of the detector array 13 is matched to the later acquired data from the second column of the detector array so as to provide a set of matched data values for two energies over the two dimensional image plane.

Referring still to FIG. 3, positioned above the detector array 13 toward the x-ray source is an aft slot 36 being a generally planar sheet 39 of radio opaque material such as lead positioned parallel to the y-z plane and normal to the fan beam axis 24 having a rectangular aperture 43 centered about the fan beam axis 24. The aperture is sized to be substantially equal in outline to the exposed face of the detector array 13 and so as to allow unobstructed passage of x-rays generally parallel to the fan beam axis 24 through the aperture 43 to strike the elements 28 and 28'. The width of the aperture along the y-axis is designated W.

The aperture 43 is surrounded by a skirt of the same radio opaque material as that which forms the aperture 43 and extending parallel to the fan beam axis 24 away from the x-ray source 12 to create a rectangular wall 44 of same cross-section as aperture 43 and with a height along the z-axis of H. The height H compared to the width W of the aperture 43 along the y-axis determines the grid ratio for the aft slot 36 and in the preferred embodiment is approximately 8:1, the slot having a height H of eight centimeters and a width W of one centimeter.

Within the rectangular wall 44 are a plurality of radiopaque lamellae 46 extending the width of the aperture 43 to form a grid 38. The lamellae of the grid 38 are approximately fifty micrometers thick and separated to provide 41 lamellae per centimeter of aft slot 36 as measured along the z axis. Thus, radiation passes through the patient 16, the aft slot 36 and grid 38 and is then received by the detector array 13.

Referring again to FIG. 2, as the fan beam 23 passes through the patient 16, some of the x-rays are scattered and diverge from the fan beam axis 24 as scattered rays 34 and 42. Some of the scattered rays 34 continue through the patient 16 at an angle so as to miss the aft slot 36 and to strike the backstop 40 and be absorbed there. Thus rays 34 do not degrade the image data collected by the detector array 13. Similarly, the collimation of the cone beam 30 into a fan beam 23 eliminates scatter from x-rays outside of the fan beam 23 as would exist in conventional area radiography. Finally, the addition of the aft slot 36 provides a shielding from multiply scattered beams 42 which diverge from the fan beam 23 and then are re-scattered to be redirected toward the detector array 13 but at an angle to the fan beam axis 24. Nevertheless, the elimination of these latter multiply-scattered beams may be expected to be less significant than the elimination of scatter as a result of collimation of the cone beam 30 to a fan beam 23.

The lamellae 46 do not stop scattered rays 34 or 42 but rather apparently reduce scatter from rays having components along the z-axis. As will be discussed further below, computer simulation has indicated that the scatter in this direction is surprisingly significant and thus the use of the grid 38 of lamellae 46 provides important scatter reduction even after that provided by the collimation of slit 32 and the collimation of aft slot 36 previously discussed.

Figure 4A:
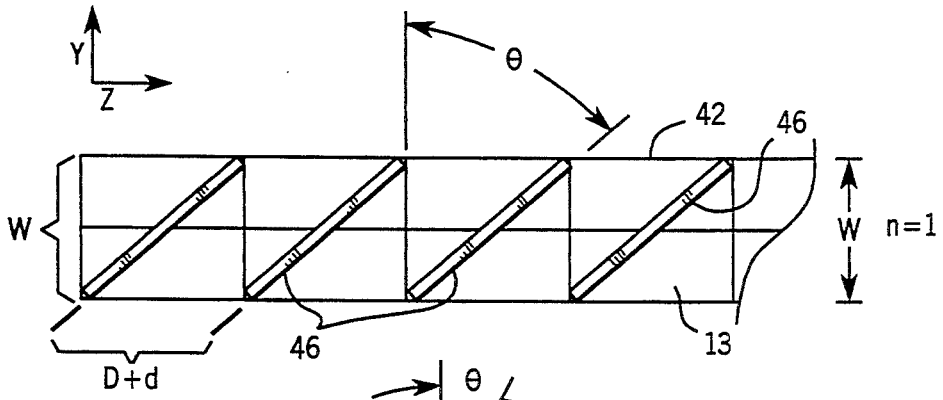
FIGS. 4(*a*), 4(*b*) and 4(*c*) are plan pictorial representations of the grid of FIGS. 2 and 3 showing different grid patterns suitable for use in the present invention.

The lamellae 46 of the grid can potentially produce grid lines or streaks in the image if every given point in the image is not swept over in equal proportion by lamellae 46 and the space between lamellae 46. Referring also to FIG. 4*a*, the lamellae 46 are accordingly angled with respect to the width of the grid along the y-axis at an angle $\theta$ so as to prevent certain portions of the image from being disproportionately occluded by lamellae 46. The lamellae 46 are fixed with respect to the underlying detector elements 28 and 28', however the motion of both the detector elements 28 and the lamellae 46 with motion of the carriage 14 causes an effective sweeping of the lamellae 46 in the z-axis direction with respect to the formed image.

Figure 4B:
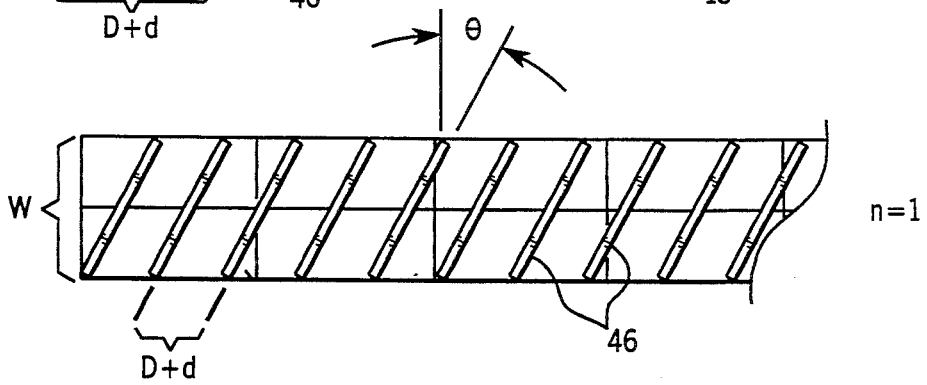
Figure 4C:
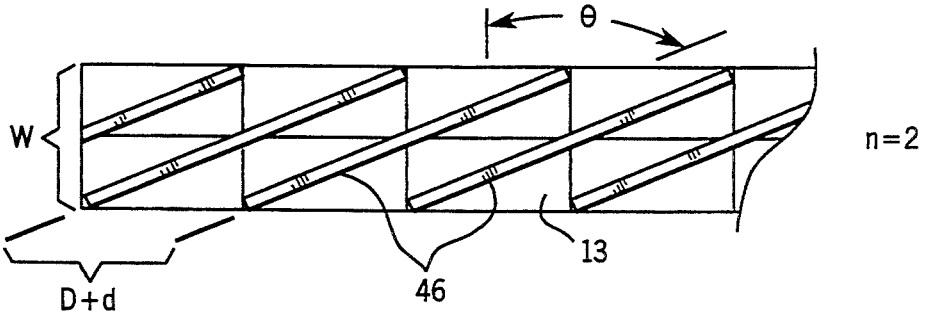

The x-rays blocked by each lamellae 46 form a shadow path that extends by the projected length of the lamellae 46 on the z-axis. Thus, ideally, the projection of each lamellae 46 on the x-axis is such that the shadow paths of each lamellae 46 just abut in the image and neither overlap nor have gaps which would produce streaks of darker or lighter image. This condition of abutting shadow paths from the lamellae 46 requires that the angle of the lamellae $\theta$ and the spacing of the lamellae along the z-axis follow certain ratios. In particular, the value of $\theta$ is equal to $$\theta = \sin^{-1}\left(\frac{n(D')}{W}\right) \tag{1}$$

Where D', the grid repeat distance, is equal to D+d where D is the spacing between each lamellae 46, and d is the thickness of the lamellae 46 (both measured perpendicularly to the lamellae) and W is the slit width as described before. n is a positive integer which when greater than one allows overlapping of the lamellae shadows as projected on the z-axis as shown in FIG. 4(*c*), but such that the every other shadow abuts in a seamless manner also eliminating bright or dark streaks.

As shown in FIG. 4(*b*), more than one lamellae 46 may cover each detector element 28, 28' with certain grid spacings D' and further the grid spacing need not be evenly divisible into the detector element spacing along each column of the detector array 13. For smaller values of D', generally the value of $\theta$ decreases.

Figure 5:
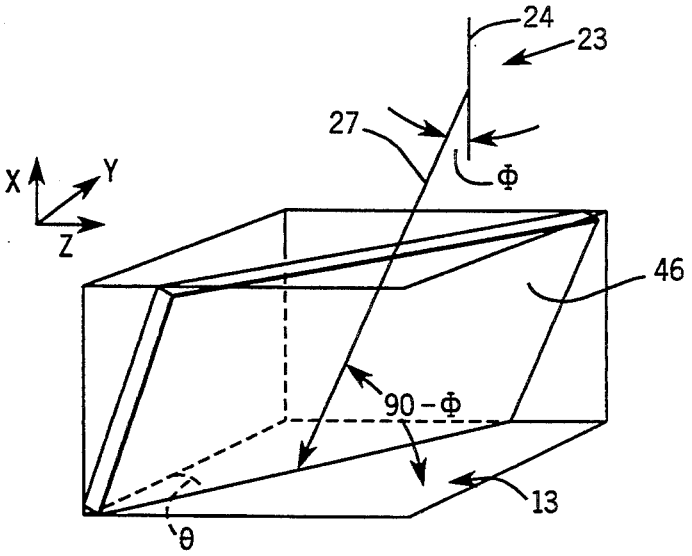
FIG. 5 is a perspective view of a single lamellae of FIGS. 3 and 4 showing the canting of the lamellae to align with the rays of the x-ray source.

Referring now to FIGS. 1 and 5, each ray 27 of the fan beam 23 diverges about the fan beam axis 24 along the z-axis at an angle $\phi$ from the fan beam axis 24, thus for the end rows of the detector array 13, the rays 27 are not truly normal to the surface of the detector array 13. In order to eliminate unnecessary occluding of the fan beam 23 by the lamellae 46, the lamellae 46 are also canted with respect to the fan beam axis 24 by an angle of $90°-\phi$ so that they present their smallest possible cross-section to each ray of the fan beam 23.

EXAMPLE 1

A computer simulation was performed of a scanning radiographic system geometry provided in Table I and a patient simulated with a 23 cm thick Lucite scattering phantom 35 cm long and 43 cm wide.

TABLE I

| | |
|---|---|
| focal spot to image distance | 150 cm |
| focal spot to slit distance | 60 cm |
| slit width | 3.5 mm |
| focal spot to slot distance | 140 cm |
| slot width | 10 mm |
| slot height | 80 mm |
| slot grid ratio | 8:1 |

The above system was simulated on a computer using a Monte Carlo methodology such as is described in the paper "*Spectral Dependence of Glandular Tissue Dose in Screen-Film Mammography*", by X. Wu, G. T. Barnes, D. M. Tucker in Radiology, 1991; 179:143–148 incorporated herein by reference. In this simulation, photon energies from 20 to 140 keV in ten key increments were employed. For each energy, photons transmitted by the slot were binned in 5 keV energy increments from 15 keV to the energy of the increment. The received photons were also separated by the cosine of their angle $\alpha$ from the z-axis (within the x-z plane). The cosine bin increments were 0, 0.1, 0.2, . . . , 0.9, 0.95 and 1.

Cos $\alpha=1$ corresponds to a photon of x-ray energy traveling parallel to its original direction substantially parallel to the fan beam axis and cos $\alpha=0$ corresponds to a scattered photon traveling along the z-axis. For energies greater than 80 keV, the histories of $6\times10^6$ photons incident on the Lucite scattering phantom were traced and for energies of less than or equal to 70 keV, the histories of $3\times10^6$ were followed.

The ratio of scattered rays to primary rays (S/P) received by the simulated detector was calculated by summing over all the cosine bins except for the cos $\alpha=1$ bin which includes both unscattered and scattered photons and where only scattered photons were counted as determined by the collision history in the simulation. The results were weighted using a published 140 kVp x-ray spectrum with a 2.5 millimeter aluminum total filtration.

The effect of the addition of a grid for each incident photon energy was calculated analytically from the Monte Carlo tracings by determining the grid transmission for each angular bin and each energy bin. These results in turn were weighted and summed for the above mentioned 140 keV spectrum.

The results are summarized in table II.

TABLE II

| Technique | S/P |
|---|---|
| normal radiography and 12:1 grid (lung) | 0.400 |
| normal radiography and 12:1 grid (mediastinum) | 1.300 |
| scanning with slot | 0.125 |
| scanning with slot and 8:1 grid | 0.055 |
| scanning with slot and 12:1 grid | 0.054 |

For the slot without the grid the scatter to primary x-ray energy fluence was 0.125. When an 8:1 grid was incorporated into the slot, this value is reduced to 0.055. Similarly, the S/P ratio for a 12:1 grid is 0.054.

The estimated precision of the Monte Carlo results is 2%. The binning and other analytical approximations introduce a potential systematic error of 5%. The Monte Carlo code was carefully benchmarked and the systematic error introduced by this phase of the methodology is less than 8%. Thus, the overall accuracy of the results is estimated to be ten percent.

The reduction in S/P ratio by use of a grid is a marked improvement over conventional techniques despite the low scatter to be expected in a scanning system.

While this invention has been described with reference to particular embodiments and examples, other modifications and variations, will occur to those skilled in the art in view of the above teachings. For example, the area of the detector array need not be limited to the area of the opening of slot but may be a stationary plate type detector, such as a storage phosphor plate, for example, of much greater area. Further, the scanning need not move both the x-ray source and detector simultaneously or in a line. If equal magnification of the image in directions both along the slot and across the slot are desired, the x-ray source may be held stationary and the slot and grid may be moved substantially in an arc about the stationary focal spot. In order to apprise the public of the various embodiments that may fall within the scope of the invention, the following claims are made.

I claim:

1. A scanning radiographic system for producing images of a patient comprising:

an x-ray source producing a fan beam of rays of x-rays directed toward the patient along a beam axis, the fan beam having a cross-sectional length and width measured in a plane perpendicular to the beam axis;

a detector array positioned to receive the fan beam after the fan beam has passed through the patient so as to produce an attenuation signal related to the intensity of the received fan beam;

a slot formed of a radiopaque material, having an aperture with a width and length substantially equal to that of the fan beam attached to move with the detector array and positioned on the same side of the patient as the detector array;

a scanner attached to the slot to scan the slot over a volume of the patient in a direction generally perpendicular to the length of the fan beam;

a grid, affixed to the slot and comprised of a set of radiopaque lamellae having a lamellae height measured along the beam axis greater than the lamellae width measured the cross-sectional length of the fan beam extending across the width of the slot so as to pass x-rays therebetween.

2. The scanning radiographic system of claim 1 wherein the lamellae extend diagonally across the width of the slot.

3. The scanning radiographic system of claim 2 wherein the lamellae are separated along the length of the slot by a repeat distance D′ and wherein the lamellae extend at an angle with respect to the length of the slot of $\theta$ where:

$$\theta = \sin^{-1}\left(\frac{n(D')}{W}\right)$$

where W is the width of the slot and n is a non-negative integer.

4. The scanning radiographic system of claim 2 wherein the lamellae are canted to reduce their cross-section measured perpendicularly to the rays of the fan beam.

5. The scanning radiographic system of claim 1 wherein the attenuation signal from the detector indicates the intensity of the received x-ray signal in two or more energy bands.

6. The scanning radiographic system of claim 1 wherein the detector array conforms in area substantially to the aperture of the slot.

* * * * *